United States Patent [19]

Carver

[11] 4,381,057

[45] Apr. 26, 1983

[54] DISPLAY CARRIERS FOR ARTICLES

[75] Inventor: Robert G. Carver, Ashland, Ohio

[73] Assignee: Don Coburn, Inc., Ashland, Ohio

[21] Appl. No.: 372,968

[22] Filed: Apr. 29, 1982

Related U.S. Application Data

[62] Division of Ser. No. 220,752, Dec. 29, 1980, abandoned.

[51] Int. Cl.[3] ..... B65D 5/04; B65D 85/62

[52] U.S. Cl. ..... 206/434; 206/426; 206/485; 206/486; 229/28 BC

[58] Field of Search ..... 206/426, 145, 146, 147, 206/154, 155, 434, 485, 486; 229/28 BC, 52 BC

[56] References Cited

U.S. PATENT DOCUMENTS

| | | | |
|---|---|---|---|
| 2,637,476 | 5/1953 | Empkie, Jr. | 206/147 |
| 2,722,365 | 11/1955 | Phipps | 206/434 |
| 2,798,655 | 7/1957 | Buttery et al. | 206/145 |
| 3,854,580 | 12/1974 | Hennessey | 206/426 |
| 3,884,353 | 5/1975 | Forte | 206/426 |
| 3,994,397 | 11/1976 | Fishlovo | 206/434 |
| 4,029,204 | 6/1977 | Mannizza | 206/434 |
| 4,093,116 | 6/1978 | Watkins et al. | 206/434 |
| 4,130,202 | 12/1978 | Champlin et al. | 206/434 |
| 4,204,598 | 5/1980 | Adams | 206/426 |
| 4,212,391 | 7/1980 | Schillinger | 206/426 |

*Primary Examiner*—Joseph Man-Fu Moy

*Attorney, Agent, or Firm*—Squire, Sanders & Dempsey

[57] ABSTRACT

Carriers for at least one pair of articles, each article having two opposed ends, employing two-ply latches for restraining hollow, recessed or chimed ends of articles inserted substantially within a carrier and/or notched flap restraints for restraining at least partially cylindrical ends of articles inserted substantially within a carrier. The notched flap restraints cooperate with a carrier reinforcing wall incorporating flap receiving and support portions to enable collapsing and reerecting of a fully assembled carrier. A conventional or collapsible carrier having flap restraints employing stop means for preventing collisions of carried articles within the carrier.

6 Claims, 8 Drawing Figures

DISPLAY CARRIERS FOR ARTICLES

This application is a division, of application Ser. No. 220,752, filed Dec. 29, 1980, now abandoned.

BACKGROUND OF THE INVENTION

Carriers for articles similar in height and breadth, such as cans and the like, having a latch for holding a hollow, recessed or chimed end of an article inserted in the carrier, are well-known. Generally, the latch is formed by punching a tab into a carrier and bending it within the carrier approximately 180°. The edge of the chimed end of the article, when thrust into the carrier, first presses the tab against the carrier wall and then, after the article rim has transversed the tab, the tab springs away from the wall to a position within the chimed end portion thereby latching the article. Examples of such latching holding devices are disclosed in the following U.S. Patent Nos: 2,637,476 issued to Empkie on May 5, 1953; 2,722,365 issued to Phipps on Nov. 1, 1955; 3,223,308 issued to Weiss on Dec. 14, 1965; 3,283,890 issued to Tolaas on Nov. 8, 1966; and 3,999,660 issued to Tranquillitsky on Dec. 28, 1976. Such latches are effective in preventing carried articles from inadvertently being removed from the carrier where both ends of the article are chimed, recessed or hollow. However, such single ply latches lack reliability when articles such as tumblers or goblets (i.e., having only one chimed, recessed or hollow end) are inserted in a carrier.

Other carriers make use of flaps, adapted to surround partially or entirely cylindrical ends of articles inserted in those carriers, to retain the article end portions substantially within the carrier. Examples of such carriers are disclosed in U.S. Pat. No. 3,598,802 issued to Nowak on Aug. 10, 1971 and No. 3,854,580 issued to Hennessey on Dec. 17, 1974. These carriers use a flap to restrain each end of an inserted article or flaps in combination with other holding means to restrain the inserted articles substantially within the carrier. Generally, these flaps are held within the carrier in a fixed angular position by locking the flap to a central reinforcing panel within the carrier. The lock consists of a slit or cut in the flap for engaging the reinforcing panel adjacent a notch in the panel.

Conventionally, carriers are assembled from flat blanks that are first printed and then punched or cut to the desired shape. After assembly, the carriers are collapsed to a relatively flat form for shipment to a location where the carriers are re-erected and the articles to be carried are inserted. Prior art carriers with locking flaps are damaged if collapsed with the flaps in place and therefore must remain partially unassembled for collapsed shipment. At the location of use of these carriers, final assembly must precede insertion of the articles adding to the cost and complexity of using these carriers.

SUMMARY OF THE INVENTION

It is an object of this invention to provide a carrier latching means by which a carrier can reliably retain inserted articles having one chimed, recessed or hollow end. Another object of this invention is to provide a carrier having flap restraints to retain inserted articles yet permit the fully assembled carrier to be collapsed and re-erected. A further object of this invention is to provide a carrier having flap restraints that reliably prevent the collision within the carton of inserted articles.

The foregoing and other objects and advantages of the present invention are achieved in a carrier having top, bottom and two side walls and a carrier latch comprised of two scored plies of carrier material formed to fit inside a chimed, recessed or hollow end of an article inserted in the carrier. Another object of this invention is achieved by providing notched flaps which span a carrier reinforcing wall that receives the folded flaps and incorporates a foldable flap support. The folding of the support and clearance provided by the notches in the flaps allow the fully assembled carrier to be collapsed and re-erected without damage to the flaps or reinforcing wall. Still another object of this invention is achieved by providing stops along the periphery of the article-receiving openings in the flaps to prevent collisions within the carrier of articles inserted into the carrier.

Further objects and advantages of the present invention will become apparent to the skilled artisan upon examination of the detailed description of the invention taken in conjunction with the figures of drawings.

DETAILED DESCRIPTION OF THE PREFERRED EMBODIMENTS

In order to explain more fully the various objects and advantages of the present invention, the invention will now be described with reference to certain preferred embodiments thereof. However, the skilled artisan will appreciate that such a description of preferred embodiments is intended to be illustrative only, and is not deemed to be limiting.

Figure 1:
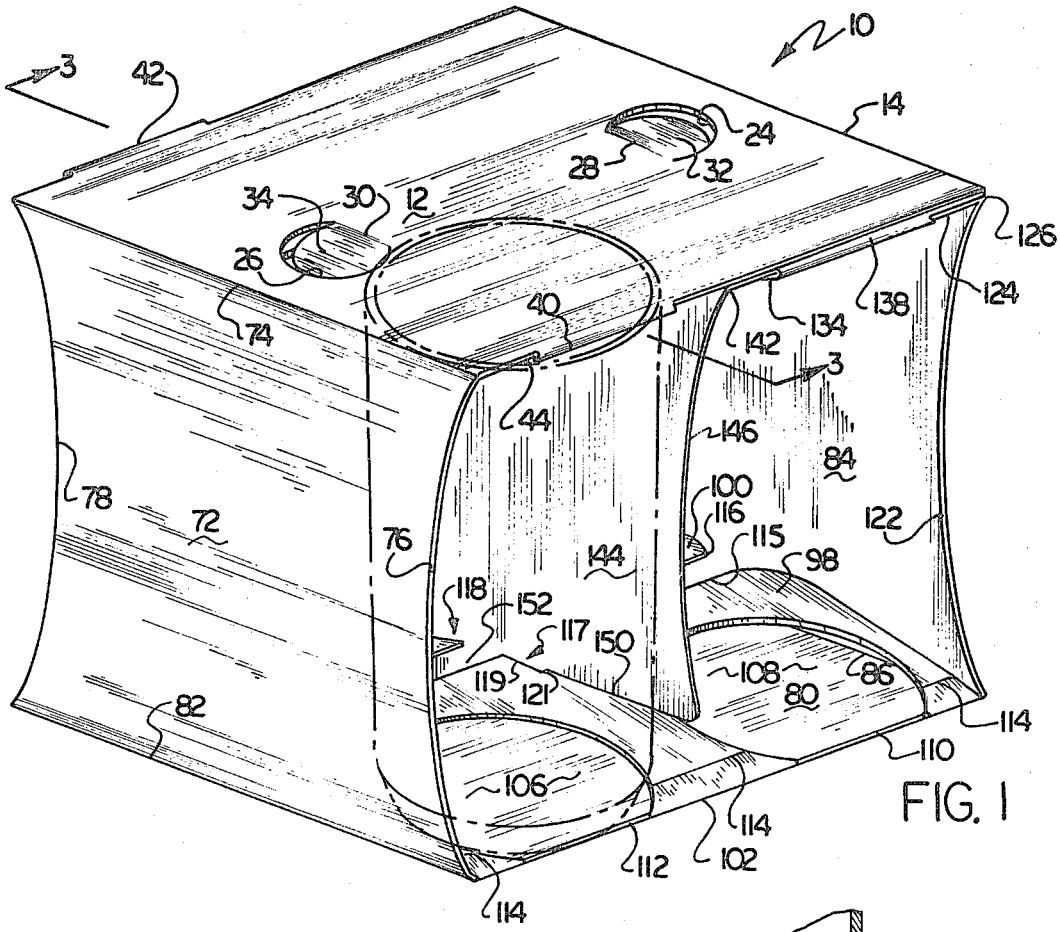
FIG. 1 is a perspective view of a carrier according to the invention showing in phantom lines an article retained substantially within the carrier.
Figure 2:
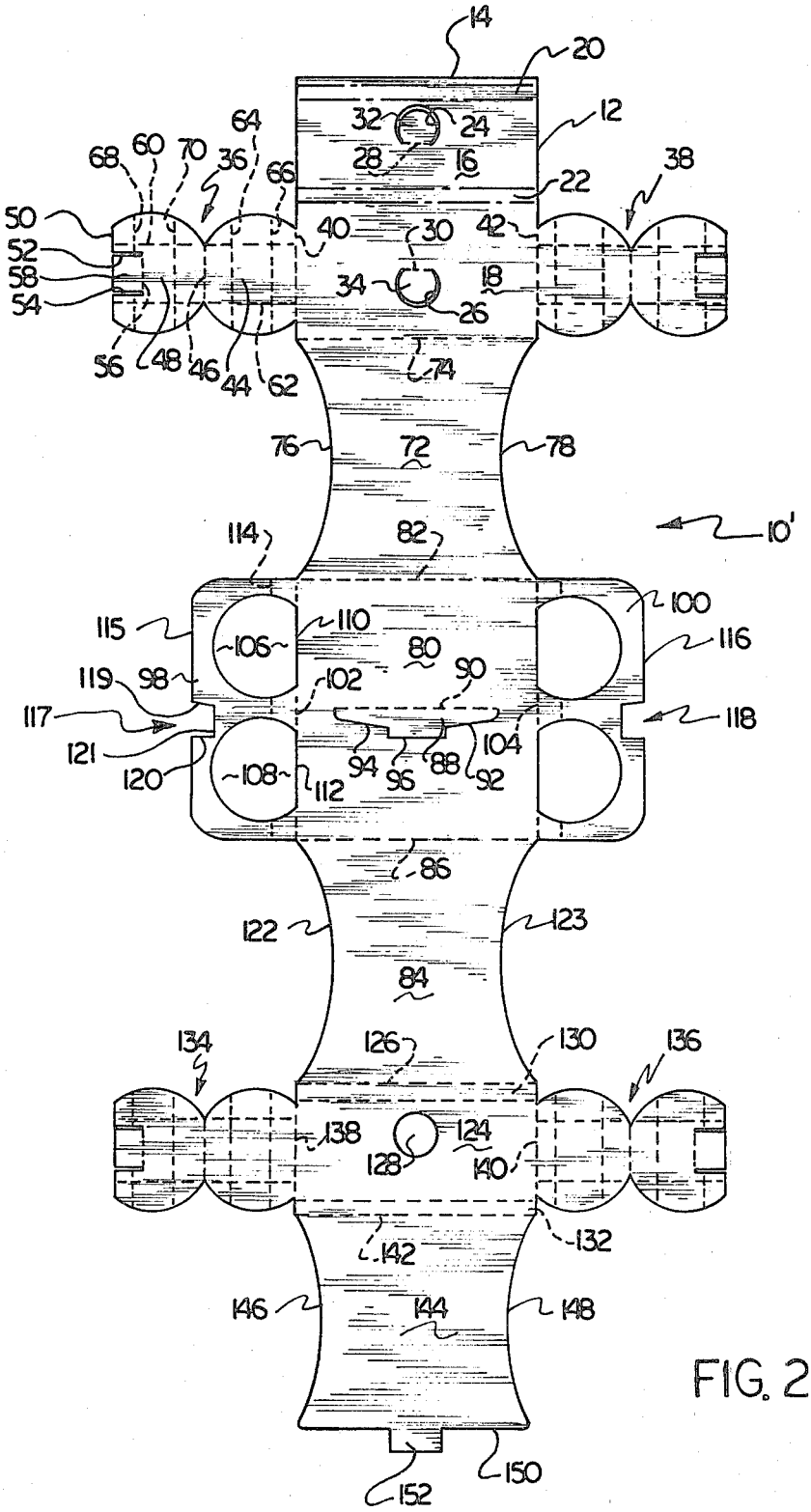
FIG. 2 is a plan view of a blank from which a carrier according to the invention may be assembled.

A preferred embodiment of the invention, carrier 10, is shown in FIG. 1. The carrier of FIG. 1 may be assembled from blank 10', comprised of an array of panels, the obverse face (as opposed to the reverse face) of which is shown in FIG. 2. For the sake of convenience, like elements of carrier 10 and blank 10′ are similarly numbered in FIGS. 1 and 2.

The carrier of FIGS. 1 and 2 has a generally rectangular top wall 12, having a lateral edge 14, and, as best viewed in FIG. 2, includes two substantially equal area, generally rectangular, transverse half top walls 16 and 18, half top wall 16 including edge 14. (For ease of description, the carrier will be described as having top, bottom and side walls without regard to any particular orientation of the carrier. The top and bottom walls abut opposing end portions of articles inserted into the carrier and the sidewalls are generally perpendicular to the top and bottom walls. Likewise, all lines parallel to edge 14 of blank 10′ will be referred to herein as lateral, while all lines perpendicular thereto will be described as transverse, regardless of actual orientation). Half wall 16 has lateral strips 20 and 22, each adapted to receive an adhesive, strip 20 being located adjacent edge 14 and strip 22 being located along the opposite lateral margin of half wall 16. Lateral strips 20 and 22 aid in assembly of the carrier as explained hereinbelow. Half walls 16 and 18 each include a laterally central arcuate cut line, 24 and 26, respectively. The figures formed by these cut lines are closed by lateral fold lines 28 and 30, respectively, so that tabs 32 and 34, respectively, are formed. In the assembled carrier, tabs 32 and 34 are folded along fold lines 28 and 30, respectively, to positions within carrier 10. The folded tabs provide both finger grips for aiding manual transportation of the carrier and separators to prevent the edges of articles inserted in the carrier from colliding.

Figure 3:
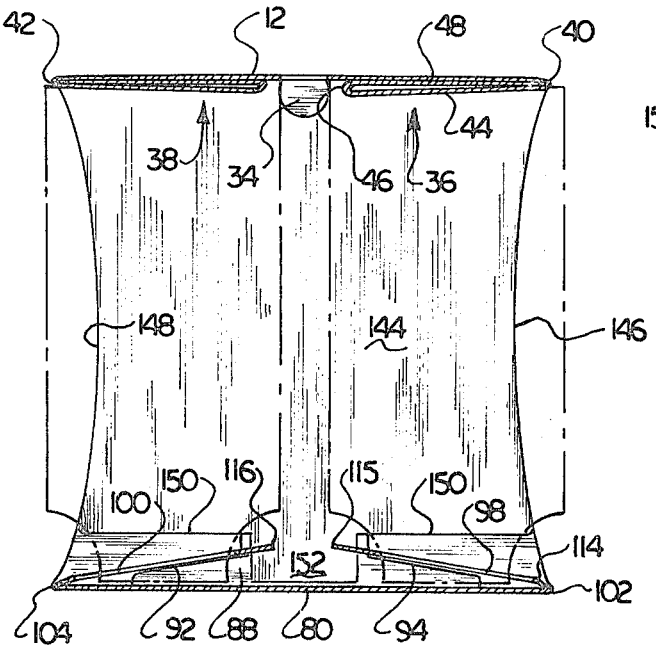
FIG. 3 is a sectional view of the carrier of FIG. 1 taken substantially along line 3—3 showing in phantom lines two articles retained substantially within the carrier.

A pair of latches 36 and 38, best viewed in FIG. 3, extend from half wall 18 along its transverse edges, namely fold lines 40 and 42, respectively. Latches 36 and 38 are adapted for use with articles having one chimed, recessed or hollow end portion and having a substantially circular cross-section. Latch 36 includes a first circular portion 44 truncated by transverse chords comprised of fold line 40 and a fold line 46. A second circular portion 48, having a diameter slightly less than the diameter of portion 44, extends from portion 48 along fold line 46. Fold line 46 and a transverse edge 50 of portion 48 truncate portion 48. Two symmetrically placed lateral cut lines 52 and 54 in portion 48 extend from edge 50 and terminate at a transverse fold line 56 in portion 48 to define therein a rectangular tab 58. The reverse side of tab 58 is adapted to receive an adhesive so that the latch folded along fold lines 40 and 46 may be affixed to the obverse side of half wall 18 as explained hereinbelow. Truncated circular portions 44 and 48 contain lateral score lines 60 and 62 intersecting the ends of fold line 46. Portion 44 has a pair of transverse score lines 68 and 70 thereon. Score lines 60-70 stiffen portions 44 and 48 of latch 36. Latch 38 is substantially identical to latch 36 so that a complete description of this structure is unnecessary. Like latch 36, latch 38 has two truncated portions separated by a transverse fold line, the distal portion containing a rectangular cut tab, and both portions having transverse and lateral score lines.

The carrier latches are formed by folding the truncated portions (e.g. portions 44 and 48) onto each other along the fold line separating them (e.g. fold line 46). Those folded portions are then folded onto the inside of a carrier wall where the rectangular cut tab (e.g. tab 58) is adhered to the carrier wall (e.g. half wall 18). The stiffening of the truncated circular portions (e.g. portions 44 and 48) by score lines (e.g. lines 60–70) aids the natural resiliency of the blank material so that the folded portions do not contact each other except proximate the edge (e.g. edge 50) of the distal portion (e.g. portion 48). That is, the effective thickness of the latch is enhanced since the stiffened portions remain substantially spaced in the assembled latch. This thickness enhancement is further aided by adhering of only a part of the distal portion (e.g. tab 58 of portion 48) to a carrier wall (e.g. half wall 18). The limited bonding area aids at least partial separation of the latch, particularly along the fold line separating the portions (e.g. fold line 46), from the adjoining carrier wall. This separation further adds effective thickness to the latch. When an article is inserted in carrier 10, the edge of the hollow end presses the latch against the adjacent wall until the article tranverses the latch. The two-ply latch springs into the article end when the article fully traverses the latch so that the latch engages the article and restrains it within the carrier. It is to be noted that the shape of the faces of the latch portions are in part substantially identical to the shape of the inside of the mating article end portion. That is, the shape of the latch portions are complementary to the shapes of ends of articles to be inserted into a carrier, not necessarily in the circular shape shown for carrier 10 and blank 10′. The latch portions are truncated, first, to permit the folding of the elements along a line (e.g. line 46) (rather than at a point) to form the two-ply latch, and, second, to permit some of the end portion of an inserted article to protrude from the carrier, if so desired. (The latch portions may be adapted in a manner obvious to one skilled in the art if an inserted article is to be retained entirely within a carrier.)

Top wall 12 joins first side wall 72 along a lateral fold line 74. Side wall 72 has arcuate generally transverse edges 76 and 78 having a medial narrowmost dimension to aid display of the articles carried in carrier 10. Side wall 72 joins a generally rectangular bottom wall 80 along a lateral fold line 83 and a second side wall 84 joins bottom wall 80 along a lateral fold line line 86. Bottom wall 80 contains a tab 88 comprising a medial lateral fold line 90, a pair of angular shoulders 92 and 94 formed from cut lines beginning at the ends of fold line 90 and ending substantially symmetrically at a central, generally rectangular tab protrusion 96. Tab 88, particularly protrusion 96, is adapted to receive an adhesive on its obverse side. Shoulders 92 and 94 provide support in carrier 10 for flaps which retain one end portion of each article inserted into the carrier.

Generally rectangular flaps 98 and 100 extend from bottom wall 80 along transverse discontinuous fold lines 102 and 104 respectively. In the embodiment shown, flap 98 has two generally circular openings 106 and 108 truncated by chords 110 and 112, respectively, chords 110 and 112 connecting the discontinuous portions of fold line 102. Openings 106 and 108 are adapted to receive at least partially cylindrical end portions of an article inserted within carrier 10. In the embodiment shown, truncated circular openings 106 and 108 are adapted to engage and restrain an inserted article end portion having a substantially circular cross-section. Different shaped openings may be devised by one skilled in the art to retain inserted articles having non-circular cross-sections. Flap 98 along its entire transverse dimensions contains, proximate transverse fold line 102, a transverse discontinuous fold line 114, fold line 114 being interrupted along its length by openings 106 and 108. Transverse edges 115 and 116 of flaps 98 and 100, respectively, are discontinuous at notches 117 and 118, respectively. Notch 117 has generally lateral edges 119 and 120 and a transverse edge 121. The maximum transverse dimension between edges 119 and 120 is larger than the transverse dimension of tab 88. The relative locations of notch 117 and tab 88 are further related in that imaginary lateral lines drawn through each of the transverse extremities of notch 117 (i.e. the intersections of notch edges 119 and 120 with flap edge 115) do not intersect tab 88, but lie on opposite lateral sides of tab 88. Because fold line 90 of tab 88 is centered on bottom wall 80 of carrier 10, the relationship of notch 117 to tab 88 is established by centrally offsetting notch 117. (As noted hereinbelow, the notch need not be offset if its transverse dimension is sufficiently large.) In addition, the lateral dimension of notch 117 is chosen so that transverse edge 121 does not contact the transverse edge of protrusion 96. One manner of preventing contact of edge 121 and protrusion 96 is by choosing the lateral distance between edge 121 and fold line 102 to be less than the lateral distance between fold line 102 and protrusion 96; however, as is obvious to one skilled in the art, such contact may be avoided in carrier 10 using different dimensional relationships. In assembling carrier 10, flap 98 is folded along fold lines 102 and 114 to a position within the carrier so that flap 98 rests on and is supported by shoulder 94 of tab 88 (tab 88 having been folded substantially perpendicular to bottom wall 80). When an article having end portions separated by a dimension substantially equal to the separation of top wall 12 and bottom wall 80 is inserted into carrier 10, the end portion inserted in a flap opening, such as opening 106 in flap 98, pushes the flap against its support, such as shoulder 94. Shoulder 94 braces flap 98 against the article end portion to enhance the holding ability of the flap. Notch 117 straddles or spans protrusion 96 of tab 88 (i.e. neither edge 119 nor 120 contacts tab 88 in carrier 10). When carrier is collapsed, notch 117 provides clearance to allow tab 88, including shoulders 92 and 94, to be folded along fold line 90 toward bottom wall 80. Notch 117 is thus configured to accommodate protrusion 96 before, during and after collapse of carrier 10, without damage to the protrusion or flap 98. Flap 100 is substantially identical to flap 98, having two openings, two transverse fold lines and a notch 118, and a complete description of its structure is unecessary.

Second side wall 84 is substantially identical to first side wall 72 having arcuate, medially narrowmost generally transverse edges 122 and 123, and joins a generally rectangular support wall 124 along a lateral fold line 126. Support wall 124 is substantially identical in size to half wall 16 and has an aperture 128 which, in carrier 10, aligns axially with tab 32. Aperture 128, which is larger than tab 32, allows tab 32 to be folded along fold line 28 to a position within carrier 10. Support wall 124 has a pair of strips 130 and 132 on its reverse side and along its lateral edges which are adapted to receive an adhesive. The reverse side of support wall 124 can thus be bonded to the obverse side of half wall 16 in assembling carrier 10. A pair of latches 134 and 136 extend laterally from transverse fold lines 138 and 140, respectively, of support wall 124. Latches 134 and 136 are substantially identical to latches 36 and 38, and a complete description of their structure is unnecessary. Each latch 134 and 136 has two doubly truncated portions separated by transverse fold lines, lateral and transverse score lines and rectangular tabs cut in the distal portions adapted to accept adhesive on their reverse sides.

Support wall 124 joins a reinforcing panel 144 along a lateral fold line 142. Panel 144 has arcuate, generally transverse edges 146 and 148 similar to edges 76, 122 and 78, 123, respectively, of first and second side walls 72 and 84. A lateral edge 150 of panel 144 has a generally rectangular protruding tab 152 adapted to receive an adhesive on its obverse side. Tab 152 is bonded in carrier 10 to tab 88 which extends from bottom wall 80. Panel 144 and tab 88 thus form a reinforcing wall disposed centrally in carrier 10 generally parallel to side wall 72 and 84 and hinged to top wall 12 and bottom wall 80.

Blank 10′ is preferably die cut or punched from a sheet of flexible, resilient material such as paperboard or a plastic. All the cut, score and fold lines are preferably formed on the blank simultaneously from the same side. An adhesive is preferably applied to lateral strips 20 and 22 on the obverse side of half wall 16 and to strips 130 and 132 on the reverse side of support wall 124. In assembling carrier 10 from blank 10′, strips 20 and 130 and 22 and 132, respectively, are bonded to each other. Depending upon the nature of the adhesive used, it may be applied to only one set of strips or the other. Adhesive is also applied to the reverse side of the tabs cut into the distal portions of the truncated, circular latch portions, tab 58 being a example of one of such tabs. Finally, adhesive is applied to the obverse side of tab 88, particularly on protrusion 96, and on tab 152.

Latches 36, 38, 134 and 136, which form one holding means for the carried articles, are formed first by folding the distal truncated circular portions onto the proximal truncated circular portions along the transverse fold lines separating them, of which fold line 46 is an example. Then the two plies are folded onto the adjacent top wall element, i.e. half wall 18 or support wall 124, along the adjoining transverse fold lines, i.e. fold lines 40, 42, 138 and 140. The two-ply latches are bonded to half wall 18 and support wall 124 by means of the adhesive previously applied to the tabs cut in the distal truncated circular portions of the latches, such as tab 58 in latch 36.

Tab 88 is then folded along lateral fold line 90 approximately ninety degrees to project from the obverse side of blank 10′. Tab 152 of reinforcing panel 144 is brought into contact with tab 88 by folding panel 144, support wall 124 and second side wall 84 along lateral fold lines 86, 126 and 142. These folds place adjacent wall elements at approximately ninety degrees with respect to each other to form a first cell or carrier sleeve. Tabs 88 and 152 are bonded together by the adhesive previously placed on them to form a reinforcing wall. (Depending upon the nature of the adhesive used, it may be necessary to apply it to only one of tabs 88 and 152). Panel 144 and tab 88 are joined only in the vicinity of the lateral center of carrier 10 at tab 152 and protrusion 96, leaving gaps in the reinforcing wall within carrier 10 on either side of tab 152 and protrusion 96. The gaps in the reinforcing wall provide a means for receiving flaps 98 and 100. Flaps 98 and 100, which form a holding means for the article inserted into the carrier, are folded along the transverse fold lines proximate bottom wall 80, fold line 114 being an example of such a fold line, toward the inside of the carrier. The folding of flaps 98 and 100 along transverse fold lines such as fold line 114 for flap 98, allows the flaps to assume positions within carrier 10 spaced from bottom wall 80, as shown in FIG. 3. Flaps 98 and 100 are then folded along transverse fold lines 102 and 104 and placed in position within the carrier.

Figure 4:
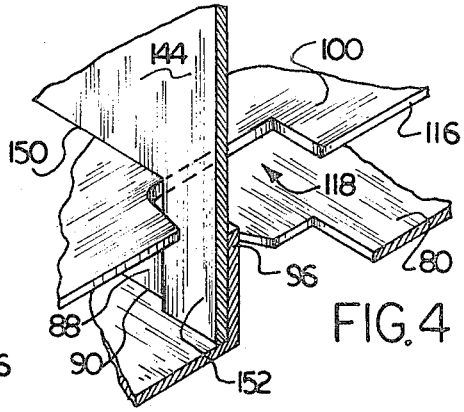
FIG. 4 is a fragmentary view of a portion of an erect carrier according to the invention showing the relationship among a notched restraining flap, a reinforcing wall receiving the flap and a foldable flap supporting in the reinforcing wall.

The flaps are inserted in the receiving means formed by panel 144 and tab 88 where they are movably engaged with pane 144. As illustrated in FIG. 4, edge 116 of flap 100 is inserted below edge 150 of panel 144. Edge 150 prevents flap 100 from unfolding under the influence of any restoring forces exerted by the resilient blank material. Notch 118 in flap 100 straddles or spans tab 152 in an offset manner, so that most of notch 118 lies on the same side of panel 144 as the half of bottom wall 80 from which protrusion 96 of tab 88 was cut. This offset is necessary with notches no larger than notches 117 and 118 to permit collapsing of assembled carrier 10 without damage as hereinbelow explained. Shoulder 92 provides a support means which holds flap 100 separated from bottom wall 80. In a like manner, flap 98 is folded to a position within carrier 10 where shoulder 94 acts as a support means, and edge 150 prevents flap 98 from unfolding. Notch 117 of flap 98 spans tabs 152 and 88.

Assembly is completed by folding first side wall 72 along lateral fold line 82 and top wall 12 along lateral fold line 74, so that the obverse side of half wall 16 is bonded to the reverse side of support wall 124. Thus a second cell or carrier sleeve is formed. Finally, tabs 32 and 34 are bent along lateral fold lines 28 and 30, respectively, to positions inside carrier 10 to form finger grips and means for keeping separate the proximate end portions of articles inserted in carrier 10. It may be desirable in some cases to interchange the order of the steps of assembly but the construction of carrier 10 will not be affected.

Figure 5:
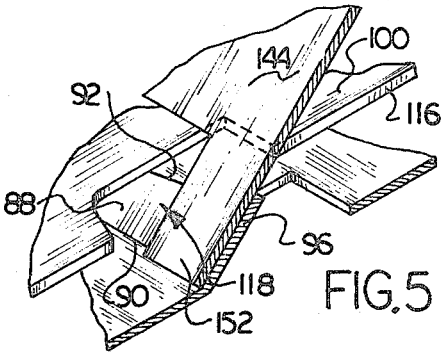
FIG. 5 is a fragmentary view of the carrier elements shown in FIG. 4, but with the carrier partially collapsed.

Conventionally, article carriers, such as the carrier of this invention are manufactured and assembled, then collapsed relatively flat for shipment to a location where the articles to be carried are inserted. Carrier 10 can be readily collapsed after full assembly because of the cooperation of notched flaps 98 and 100 with the reinforcing wall comprising panel 144 and tab 88. Carrier 10 may be collapsed by a compressive force applied to fold lines 74 and 86. As illustrated in FIGS. 4 and 5, those forces cause top wall 12 and bottom wall 80 to approach each other and fold lines 14, 74, 82, 86, 90 and 142 to act as hinges. The compressive force is applied until carrier 10 assumes a relatively flat form. For carrier 10, the collapsed flap form preferably has a maximum thickness of five times the thickness of the material used, that thickness occurring in the part of the collapsed carrier including the latches.

The hinge formed by fold line 90 permits the support means comprising shoulders 92 and 94 to be foldable. Thus, when carrier 10 is being collapsed, the reinforcing wall formed by panel 144 and tab 88 becomes inclined, remaining generally parallel to side walls 72 and 84, and the foldable support means folds away from supporting flaps 98 and 100. Flaps 98 and 100 are therefore allowed to move toward bottom wall 80 during the collapse. As the flaps move toward bottom wall 80 and the reinforcing wall inclines, the flaps and reinforcing wall would collide or rub causing bending and damage were it not for the configuration of notches 117 and 118. The transverse dimensions of the notches spanning the reinforcing wall permit the passage of the reinforcing wall and the absence of contact between edge 121 and protrusion 96 prevents rubbing before, during and after carrier 10 is collapsed. Those notches, which in carrier 10 are offset on the side of panel 144 which approaches bottom wall 80, thus provide sufficient clearance so that no collision, rubbing or damage occurs during the collapsing. As is obvious to one skilled in the art, notches 117 and 118 would not provide the desired clearance if they were symmetrically placed about panel 144 unless the notches had relatively larger transverse dimensions. While it is preferred that notches 117 and 118 be offset as shown, the notches could be transversely offset to the other side of panel 144 with the carrier collapsing to the opposite side from that previously described. Similarly, a notch having a sufficiently large transverse dimension would permit a carrier according to the invention to be collapsed in either direction.

The articles to be inserted in carrier 10 may either be inserted in the carrier as assembled or after re-erection of a collapsed, assembled carrier. A carrier 10, collapsed as described, may be re-erected by placing a compressive force on fold lines 14 and 82 until the angles formed between bottom wall 80 and first and second side walls 74 and 84 are approximately ninety degrees. Insertion of rigid articles will cause the carrier to maintain its desired shape.

As best illustrated in FIG. 3, carrier 10 is adapted to carry articles having one chimed, recessed or hollow end and one cylindrical end. The side walls 72 and 84 are dimensioned so that the separation of top wall 12 and bottom wall 80 is slightly greater than the height of the articles to be inserted. As an article, as shown in phantom in FIG. 3, is thrust into carrier 10, the material of a flap, such as flap 98 or 100, is momentarily pressed toward bottom wall 80 until the cylindrical end portion of the article is admitted into a flap opening, such as opening 106 or 108. Once that article is fully inserted, the flap, under the bracing influence of the shoulder formed by tab 88, springs away from bottom wall 80 with the opening engaging the article end, thereby restraining it substantially within the carrier. The fold in each flap, such as the fold along fold line 114 in flap 98, in combination with the bracing influence of the flap supports such as supports 92 and 94, maintain the flaps spaced above bottom wall 80 and in an engaging and restraining configuration with the end portions of inserted articles.

The same positive restraining ability achieved by flaps 98 and 100 in carrier 10 is obtained by a latch such as latch 36, 38, 134 or 136. As illustrated in FIG. 3, the dimensions of the latch are chosen so that inside rims of inserted articles bear upon the arcuate edges of the latch. That is, for latch 36, the diameter of the circular part of portion 44 is substantially equal to the inside diameter of the article to be inserted into and latched within carrier 10. (Generally, the distal portion of the latch, such as portion 48 of latch 36, is somewhat smaller than the proximal portion, such as portion 44. The difference in portion sizes eliminates the need for exact registration of the portions in order to engage properly a chimed, hollow or recessed end portion of an inserted article.) The construction of the latches assures that inserted articles are positively retained even though the carrier is distorted during handling. As previously explained, the natural resiliency of the carrier material insures that the truncated circular portions of a latch, such as portions 44 and 48 of latch 36, do not fold tightly against each other along their common fold line, such as fold line 46. Thus a latch with two plies of material has added effective thickness aiding its latching function. Further, the score lines on each truncated circulated portion, such as lines 60, 62, 64, 66, 68, 70 on the portions of latch 36, stiffen those portions and enhance the effective thickness of a latch. Finally, since only a fraction of the area of the distal truncated circular portion of a latch is adhered to the inside of top wall 12 or support wall 124, such as tab 58 being adhered to top wall 12, the latch elements are allowed to "spring" away from the adhering wall. This springing further adds to the effective thickness of a latch. An article is simply inserted in a carrier since the leading edge of the article compresses the latch elements against the adjoining wall during the insertion. Once the leading edge of the inserted article fully traverses a latch relieving the compression, the latch elements are released to spring into and restrain the article end portion.

Many carriers incorporate finger grips and some carriers employ the tabs associated with finger grips or the equivalent to assist in holding inserted articles within a carrier. In those designs the finger grip tabs are folded, after insertion of articles into a carrier, so that the tabs protrude within hollow article end portions. Because of the effectiveness of the latches of the present invention, additional restraining security for inserted articles is not necessary. Finger grip tabs 32 and 34 of carrier 10 are therefore devoted to maintaining separate within carrier 10 the rims and end portions of articles inserted on each of the sides of panel 144. The inserted article separation means provided by tabs 32 and 34 is a particularly important advantage of carrier 10 when the articles to be inserted are fragile. The separation function of the tab is accomplished by choosing the dimensions of carrier 10 so that inserted articles are sufficiently laterally separated within the carrier to permit a tab to be disposed between the articles. In FIG. 3 such an arrangement is shown with tab 34 disposed between the hollow ends of the two articles shown in phantom lines. The locations of tabs 32 and 34 are chosen, so that when bent inside carrier 10, edges of the tabs bear on the inserted articles approximately where an imaginary lateral line drawn between the centers of inserted articles intersects the outside edges of the articles. That is, fold lines 26 and 28 are approximately transversely centered on half walls 16 and 18, respectively, as well as being substantially laterally centered. In other words, for carrier 10, which is intended to carry four articles, fold line 28 is located approximately one quarter of the transverse dimension of top wall 12 from lateral edge 14 of wall 12 and fold line 30 is located approximately three quarters of the transverse dimension of top wall 12 from edge 14. For other carriers according to the present invention intended for carrying other than four inserted articles, the fold lines for separating tabs would be approximately located from a lateral edge of the carrier's top wall a fraction of the top wall's transverse dimension equal to the odd multiples of the reciprocal of the number of articles that the carrier is intended to have inserted within it. For example, a six article carrier would have three separation tab fold lines approximately laterally centered on the top wall of the carrier, located approximately 1/6, 3/6 (i.e., ½) and 5/6 of the transverse dimension of the top wall from a lateral edge of the top wall. The separation tabs in a carrier according to the present invention protect inserted articles from collision in a lateral direction. In carrier 10, inserted articles are protected in a transverse direction by panel 144.

Figure 6:
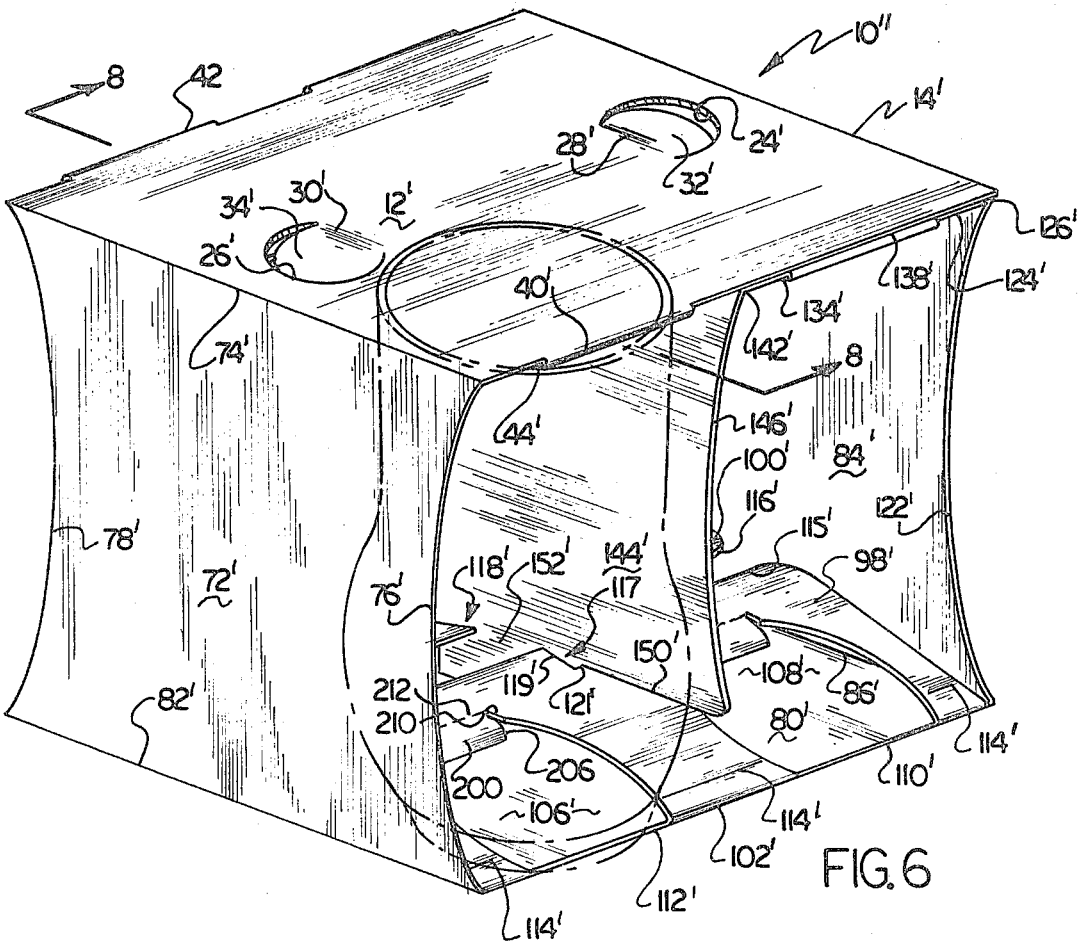
FIG. 6 is an alternate embodiment of the carrier of FIG. 1, showing in phantom lines an article having a varying cross-section retained substantially within the carrier.
Figure 7:
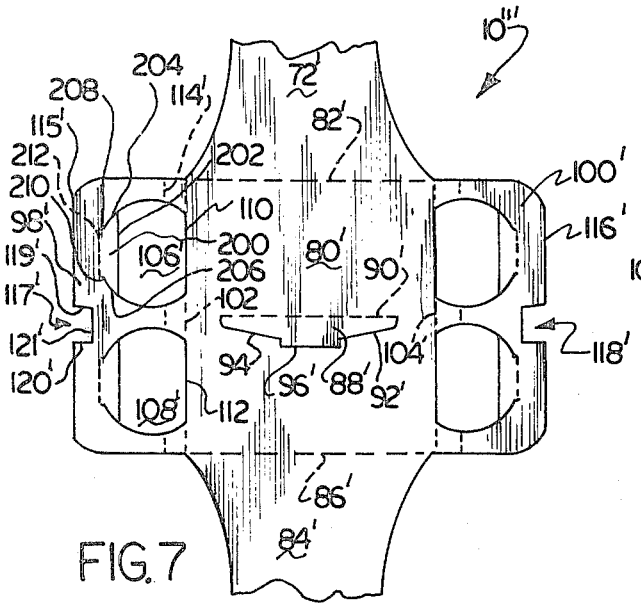
FIG. 7 is a plan view of a portion of a blank from which the alternate embodiment of the carrier of FIG. 1 shown in FIG. 6 may be assembled.
Figure 8:
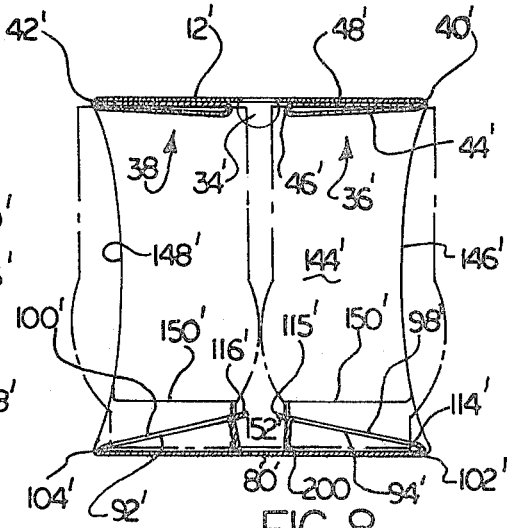
FIG. 8 is a sectional view of the embodiment of the carrier of FIG. 6 taken substantially along line 8—8 showing in phantom lines two articles of varying cross-section retained substantially within the carrier.

An alternative embodiment, a carrier 10″, of carrier 10 providing additional security against collision within the carrier of inserted objects is depicted FIGS. 6 and 8. Carrier 10″ is entirely analogous to carrier 10 except that additional stop means are provided in flaps 98 and 100 of carrier 10. A portion of a blank 10‴ from which carrier 10″ may be assembled is illustrated in FIG. 7. Except as shown in FIG. 7, the elements of the blank 10‴ from which carrier 10″ is formed are identical to the elements of blank 10′. All elements of FIGS. 6, 7 and 8 which correspond to the elements of FIGS. 1, 2 and 3, respectively, have been given the same numeral designation with the addition of a prime.

The additional stop means consists of a hinged stop disposed in blank 10‴ within each opening in each flap, such as stop 200 in opening 106′ illustrated in FIG. 7. Stop 200 has a transverse edge 202 which in blank 10‴ forms a boundary of opening 106′ opposite transverse chord 110′. Arcuate cut lines 204 and 206 connect the respective ends of edge 202 following the curvature of opening 106′, to lateral cut lines 208 and 210 which lie between opening 106 and edge 115′ of flap 98′. Cut lines 208 and 210 terminate at the ends of a transverse fold line 212 which forms the hinge of stop 200. A stop means similar to stop 200 is formed in each of the openings of flaps 98′ and 100′ so that a detailed description of each stop means is unnecessary.

Assembly of carrier 10″ is carried out in the same manner as assembly of carrier 10 with the result that the stop means are positioned near the innermost part of the carrier. Insertion of the articles to be carried is identical in carriers 10 and 10″. However, in carrier 10″, the portion of the end of an article which will be near the innermost part of the carrier, when inserted into an opening in a flap, presses against the stop means, such as stop 200 in opening 106′, causing it to bend along its hinge, such as fold line 212, and assume a position with edge 202 touching bottom wall 80′. Because flaps 98′ and 100′ are inclined with respect to bottom wall 80′, with the flap edge spaced above bottom wall 80′ and the outside edge hinged to bottom wall 80′, insertion of articles causes the stops, such as stop 200, to bend toward bottom wall 80′. This positioning of the stop means is best shown in FIG. 8. The lateral dimension of a stop means 200, i.e. the distance between edge 202 and fold line 212, is chosen so that when the stop 200 is in use, edge 202 bears upon bottom wall 80′. In that configuration the effectiveness of stop means 200 is obtained through the frictional resistance of edge 202 on bottom wall 80′. Stop means, such as stop means 200, have been found effective in preventing collisions of articles within a carrier, such as carrier 10″, during handling where the carried articles have a center of mass located near the bottom wall of a carrier, such as bottom wall 80′. Such a situation occurs, for example, when the articles to be carried are glass tumblers having solid glass bases, retained in the flap openings. The problem of collisions of carried articles within a carrier during handling is particularly acute when the articles have a varying cross-section as illustrated by the carried articles shown in phantom lines in FIGS. 6 and 8. Because of the varying cross-sections, the clearance between the carried articles may be quite small at some locations within the carrier. The addition of hinged stop means, such as stop 200, has been found effective to prevent collision of such articles without the provision in the carrier of excessive separation between the articles.

Obviously, the stop means cannot be folded into position if it is desired to collapse carrier 10″ subsequently. However, use of stop means in no way interferes with the conventional order of assembling the carriers, collapsing them for shipment and then assembling them for insertion of articles.

The benefits of a stop means, such as stop 200, in preventing collisions within a carrier of inserted articles is not limited to a collapsible carrier, such as carrier 10". Conventional article carriers having top, bottom and sidewalls and employing flaps with openings for receiving the ends of inserted articles, where the flaps extend from the top and/or bottom walls and are folded into the carrier may also advantageously use such stop means. In these applications it is important that the flaps be in an inclined position so that the separation of the flaps and the top and/or bottom walls increase with the position of the flap within the carrier if an article is to push the stop means into position as the article is inserted into the carrier. Alternatively, the stop means could be positioned manually. For example, carriers such as disclosed by Nowak in U.S. Pat. No. 3,598,302 and by Hennessey in FIGS. 5 through 8 of U.S. Pat. No. 3,854,580, could incorporate such stop means.

Given the principles of the present invention as set forth herein, those skilled in the art will have no difficulty in selecting appropriate dimensions for a carrier, its latching, engaging and restraining, separation and stop elements to achieve the described results.

Because of the positive manner by which carriers 10 and 10" retain the articles inserted into them, the articles are best removed by destruction of the carriers. Alternatively, the articles may be removed by distortion of the latches and flaps.

As the skilled artisan will recognize, carriers 10 and 10" are but two embodiments of the invention which may be varied within the spirit of the invention. For instance, if the articles to be inserted in a carrier have both end portions chimed, recessed or hollow (or a combination thereof), the flaps of carrier 10 may be dispensed with in favor of bottom latches disposed on the inside of the bottom wall of a carrier, similar to top latches 36, 38, 134 and 136 disposed on the inside of top wall 12 and support wall 124 of carrier 10. Likewise, flaps might be used in conjunction with holding or restraining means, such as a second set of flaps, other than latches to restrain the end portions of inserted articles. Since the terms top wall and bottom wall are used herein without regard to actual orientation of a carrier, it is recognized that a reference to flaps, latches or the like being on or extending from the bottom wall of a carrier, be it carrier 10 or 10", a conventional carrier employing stop means or any other carrier embodiment, includes the same disposition of those elements on or extending from what in some instances might be designated the top wall. Where flaps and/or latches are used with inserted articles not having circular cross-section end portions, the shapes of the openings in the flaps and the shapes of the latches will be adapted so that the article end portions will be engaged and restrained by the flaps and/or latches used. In yet another embodiment, a carrier might be constructed for insertion of only two articles, as for example by halving blank 10' or 10"' along a transverse center line and constructing two carriers. The invention is not limited to carriers for two or four articles, and carriers within the spirit of the invention for six and more articles may be constructed. In such an embodiment the equivalent of panel 144 may not be centrally disposed within the carrier, but rather could be one or more panels all of which are generally parallel to the side walls and generally perpendicular to the top and bottom walls. Likewise, other embodiments might have more or fewer finger and article separation tabs, equivalent to tabs 32 and 34 of carrier 10, so that latched end portions of inserted articles remain laterally separated within the carrier. In any embodiment, the arcuate edges 76, 78, 122, 123, 146 and 148 of first and second side walls 72 and 84 and panel 144 of the carrier 10 embodiment assist in displaying the carried articles. However, it may be useful in some embodiments of carriers for those or the equivalent wall edges to be straight. To protect articles, other embodiments might preferably have the equivalent edges protrudingly arcuate or the articles might be fully inside the carrier.

Thus, although the invention has been described with reference to certain preferred embodiments, the skilled artisan will recognize that various substitutions, changes, modifications or omissions may be made without departing from the spirit thereof. Accordingly, it is intended that the scope of the invention be limited solely by the following claims.

I claim:

1. A carrier for retaining at least one pair of articles to be inserted therein, the articles each including two opposing end portions, where at least one of the articles' end portions is at least partially cylindrical, said carrier being formed of a flexible material and comprising:

top and bottom walls;

a pair of side walls, each side wall being hingedly attached to each of said top and bottom walls to form a carrier sleeve;

holding means joined to said top panel for holding one of the end portions of articles to be inserted into said carrier;

at least one flap extending from said bottom wall and folded to a position within said carrier proximate said bottom wall, each flap having at least one opening therein for receiving and engaging an at least partially cylindrical end portion of an article to be inserted into said carrier; and a reinforcing wall disposed within said carrier opposed to said side walls and hingedly attached to said top and bottom walls, said reinforcing wall including receiving means proximate said bottom wall for receiving each said flap and further including foldable support means proximate and hingedly attached to said bottom wall for supporting said flap within said carrier, each said flap including on a transverse edge a notch straddling said reinforcing wall, said foldable support means collapsing when said carrier is collapsed to a relatively flat form by hinging operation of said hinged attachments of said walls, said foldable support means folding away from supporting each said flap and each said notch being configured to allow passage of said reinforcing wall before, during and after collapsing of said carrier.

2. The carrier of claim 1 wherein each of said flaps includes stop means for stopping the end portions of articles, when inserted within said openings, from further movement into said carrier, said stop means depending from each of said flaps and frictionally engaging said bottom wall.

3. The carrier of claim 1 for retaining at least two pairs of articles to be inserted therein, including separation means on the inside of said top wall for maintaining laterally separate within said carrier the end portions of a pair of articles to be inserted into said carrier.

4. The carrier of claim 3, wherein said separation means comprises a tab hingedly depending from a substantially laterally centered lateral fold line on said top wall, said fold line being substantially located from a lateral edge of said top wall a fraction of the transverse dimension of said top wall equal to an odd multiple of the reciprocal of the number of articles that said carrier is intended to have inserted within it.

5. The carrier of claim 1 for retaining articles to be inserted therein, the articles each having a first end portion chimed, recessed or hollow, wherein said holding means comprises two-ply top latching means disposed on the inside of said top wall for latching said first end portions of each of said articles to be inserted into said carrier.

6. A blank for forming a carrier for retaining at least one pair of articles to be inserted therein, the articles each including two opposing end portions, where at least one of the articles' end portions is at least partially cylindrical, said blank comprising an array of panels including a bottom wall panel including a hinged tab having a central lateral hinge, a top wall panel, first and second side wall panels, a reinforcing panel having a centered tab extending from a lateral edge for attachment to said hinged tab, and at least one flap extending from said bottom wall, said flap having at least one opening therein for receiving and engaging an at least partially cylindrical end portion of an article to be inserted and having a notch on a transverse edge, said notch having a transverse dimension greater than the transverse dimension of said hinged tab and being disposed so that extensions of lateral lines intersecting the transverse extremities of the notch lie on opposite sides of said hinged tab.

* * * * *